US011615732B2

(12) United States Patent
Kim et al.

(10) Patent No.: US 11,615,732 B2
(45) Date of Patent: Mar. 28, 2023

(54) DISPLAY DEVICE WITH ADJUSTABLE SLEW RATE AND OUTPUT TIMING OF A DATA SIGNAL ACCORDING TO A POSITION OF A SIGNAL LINE

(71) Applicant: SAMSUNG DISPLAY CO., LTD., Yongin-si (KR)

(72) Inventors: Jong Soo Kim, Yongin-si (KR); Chae Hee Park, Yongin-si (KR); Bong Hyun You, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/340,447

(22) Filed: Jun. 7, 2021

(65) Prior Publication Data

US 2022/0051606 A1 Feb. 17, 2022

(30) Foreign Application Priority Data

Aug. 14, 2020 (KR) ..... 10-2020-0102730

(51) Int. Cl.
*G09G 3/20* (2006.01)

(52) U.S. Cl.
CPC ... *G09G 3/2007* (2013.01); *G09G 2310/0202* (2013.01); *G09G 2310/027* (2013.01); *G09G 2310/0267* (2013.01); *G09G 2310/0286* (2013.01); *G09G 2310/0291* (2013.01); *G09G 2310/08* (2013.01); *G09G 2320/0223* (2013.01)

(58) Field of Classification Search
CPC ..... G09G 3/3266
See application file for complete search history.

(56) References Cited

U.S. PATENT DOCUMENTS

| | | | | |
|---|---|---|---|---|
| 9,626,912 | B2 | 4/2017 | Kim et al. | |
| 10,049,637 | B2 | 8/2018 | Lee et al. | |
| 10,417,970 | B2 | 9/2019 | Son et al. | |
| 2007/0075937 | A1* | 4/2007 | Kim | G09G 3/3233 345/76 |
| 2017/0047016 | A1* | 2/2017 | Son | G09G 3/3233 |

FOREIGN PATENT DOCUMENTS

| | | | |
|---|---|---|---|
| KR | 1020160093153 | A | 8/2016 |
| KR | 1020160142937 | A | 12/2016 |
| KR | 1020170019021 | A | 2/2017 |

* cited by examiner

*Primary Examiner* — Gustavo Polo
(74) *Attorney, Agent, or Firm* — Cantor Colburn LLP

(57) ABSTRACT

A display device includes a pixel unit including pixels connected to data lines and scan lines; a data driver disposed on one side of the pixel unit; a scan driver disposed on the one side of the pixel unit together with the data driver; and a controller which controls a slew rate and output timing of data signals output to the data lines based on a load of the scan lines and a load of the data lines. Each of the scan lines includes a main scan line extending in a first direction and connected to pixels in a corresponding pixel row; a first sub-scan line extending in a second direction and connected to the main scan line at a first contact point; and a second sub-scan line extending in the second direction and connected to the main scan line at a second contact point.

20 Claims, 9 Drawing Sheets

DISPLAY DEVICE WITH ADJUSTABLE SLEW RATE AND OUTPUT TIMING OF A DATA SIGNAL ACCORDING TO A POSITION OF A SIGNAL LINE

The application claims priority to Korean Patent Application No. 10-2020-0102730, filed Aug. 14, 2020, and all the benefits accruing therefrom under 35 U.S.C. § 119, the content of which in its entirety is herein incorporated by reference.

BACKGROUND

Field

The present invention relates to an electronic device, and more particularly, to a display device.

Discussion

In general, a display device has a structure in which a scan driver is disposed on one side of a pixel unit and a data driver is disposed on the other side. A structure for implementing a narrow bezel in which non-display areas on both sides of the display device are minimized is being developed. For example, in order to implement the narrow bezel, a panel of a single side driving type in which the scan driver and the data driver are disposed together on one side is being studied.

In the single side driving type display device, scan lines may have different lengths. Due to the structure of the scan lines, a resistor-capacitor ("RC") load corresponding to each position of a pixel may be non-uniform, and a timing at which a scan signal and a data signal are supplied to each of pixels may not be synchronized. Accordingly, differences in data charging rates may occur and display quality may deteriorate.

SUMMARY

An aspect of the present invention is to provide a display device that adjusts a slew rate of a data signal based on a load according to a position of a scan line and/or a data line.

Another aspect of the present invention is to provide a display device that adjusts an output timing of a data signal based on a load according to a position of a scan line and/or a data line.

However, aspects of the present invention are not limited to the above-described aspects, and may be variously extended without departing from the spirit and scope of the present invention.

In order to achieve the aspects of the present invention, a display device according to embodiments of the present invention includes a pixel unit including pixels connected to data lines and scan lines; a data driver disposed on one side of the pixel unit to drive the data lines; a scan driver disposed on the one side of the pixel unit together with the data driver to drive the scan lines; and a controller which controls a slew rate and output timing of data signals output to the data lines based on a load of the scan lines and a load of the data lines. Each of the scan lines may include a main scan line extending in a first direction and connected to pixels in a corresponding pixel row; a first sub-scan line extending in a second direction different from the first direction and connected to the main scan line at a first contact point; and a second sub-scan line extending in the second direction and connected to the main scan line at a second contact point.

According to an embodiment, the controller may adjust an over-driving pulse of the data signals according to a scan line to which a scan signal is supplied among the scan lines.

According to an embodiment, for the same grayscale, a width of the over-driving pulse of the data signals supplied to a first pixel row corresponding to a first scan line of the scan lines may be smaller than a width of the over-driving pulse of the data signals supplied to a second pixel row corresponding to a second scan line of the scan lines. The main scan line of the first scan line and the first pixel row may each be closer to the data driver than each of the main scan line of the second scan line and the second pixel row.

According to an embodiment, for the same grayscale, a height of the over-driving pulse of the data signals supplied to a first pixel row corresponding to a first scan line of the scan lines may be smaller than a height of the over-driving pulse of the data signals supplied to a second pixel row corresponding to a second scan line of the scan lines. The main scan line of the first scan line and the first pixel row may each be closer to the data driver than each of the main scan line of the second scan line and the second pixel row.

According to an embodiment, the controller may increase at least one of a width of the over-driving pulse and a height of the over-driving pulse as the load of the data lines increases.

According to an embodiment, at least one of the width of the over-driving pulse and the height of the over-driving pulse may increase as the main scan line to which the scan signal is supplied is further away from the data driver.

According to an embodiment, the controller may adjust the output timing of the data signals for each of the scan lines according to a position of a target pixel connected to the main scan line.

According to an embodiment, the controller may adjust the output timing of the data signals based on a distance between the target pixel and the first contact point and a distance between the target pixel and the second contact point.

According to an embodiment, for the same grayscale, a data signal supplied to a first pixel connected to a first position of the main scan line may be output later than each of a data signal supplied to a second pixel connected to a second position of the main scan line and a data signal supplied to a third pixel connected to a third position of the main scan line. The pixels may include the first to third pixels. The first position of the main scan line may correspond to an intermediate point between the first contact point and the second contact point, the second position of the main scan line may be closer to the first contact point than the first position, and the third position of the main scan line may be closer to the second contact point than the first position.

According to an embodiment, when the scan signal is supplied to the main scan line, output timings of the data signals for the same grayscale may be faster as the data lines are closer from the first pixel to the first contact point or the second contact point.

According to an embodiment, when the scan signal is supplied to the main scan line, output timings of the data signals for the same grayscale output to the data lines connected to the pixels on a side of the first contact point opposite to the first position may be further delayed as a distance from the first contact point increases.

According to an embodiment, when the scan signal is supplied to the main scan line, output timings of the data signals for the same grayscale output to the data lines connected to the pixels on a side of the second contact point opposite to the first position may be further delayed as a distance from the second contact point increases.

According to an embodiment, the controller may further delay the output timing of the data signals as a load of the main scan line increases.

According to an embodiment, first sub-scan lines and second sub-scan lines of the scan lines may gradually increase in length measured in the second direction toward the first direction.

According to an embodiment, the data driver may include a latch which latches image data and outputs latched image data in units of pixel rows; a digital-to-analog converter which converts the latched image data into the data signals; and an output buffer which outputs the data signals to the data lines.

According to an embodiment, the controller may include a memory in which over-driving values and shift values corresponding to predetermined points of the pixel unit are stored; a slew rate controller which generates an over-driving pulse of a data signal supplied to a target pixel based on a position of the main scan line to which the target pixel is connected and the over-driving values; and a latch controller which controls an output timing of the latched image data from the latch based on a position of the target pixel on the main scan line and the shift values.

According to an embodiment, the controller may adjust a bias voltage supplied to the output buffer according to a scan line to which the scan signal is supplied among the scan lines.

According to an embodiment, the controller may include a memory in which bias values and shift values corresponding to predetermined points of the pixel unit are stored; a slew rate controller which adjusts the bias voltage supplied to the output buffer corresponding to the target pixel based on the position of the main scan line to which the target pixel is connected and the bias values; and a latch controller which controls output timings of the image data of the latch based on a position of the target pixel on the main scan line and the shift values.

According to an embodiment, the controller may increase the bias voltage as the load of the data lines increases.

According to an embodiment, the controller may adjust the over-driving pulse of the data signals according to the scan line to which the scan signal is supplied among the scan lines, and adjust the output timing of the data signals according to a position of a target pixel connected to the main scan line to which the scan signal is supplied.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
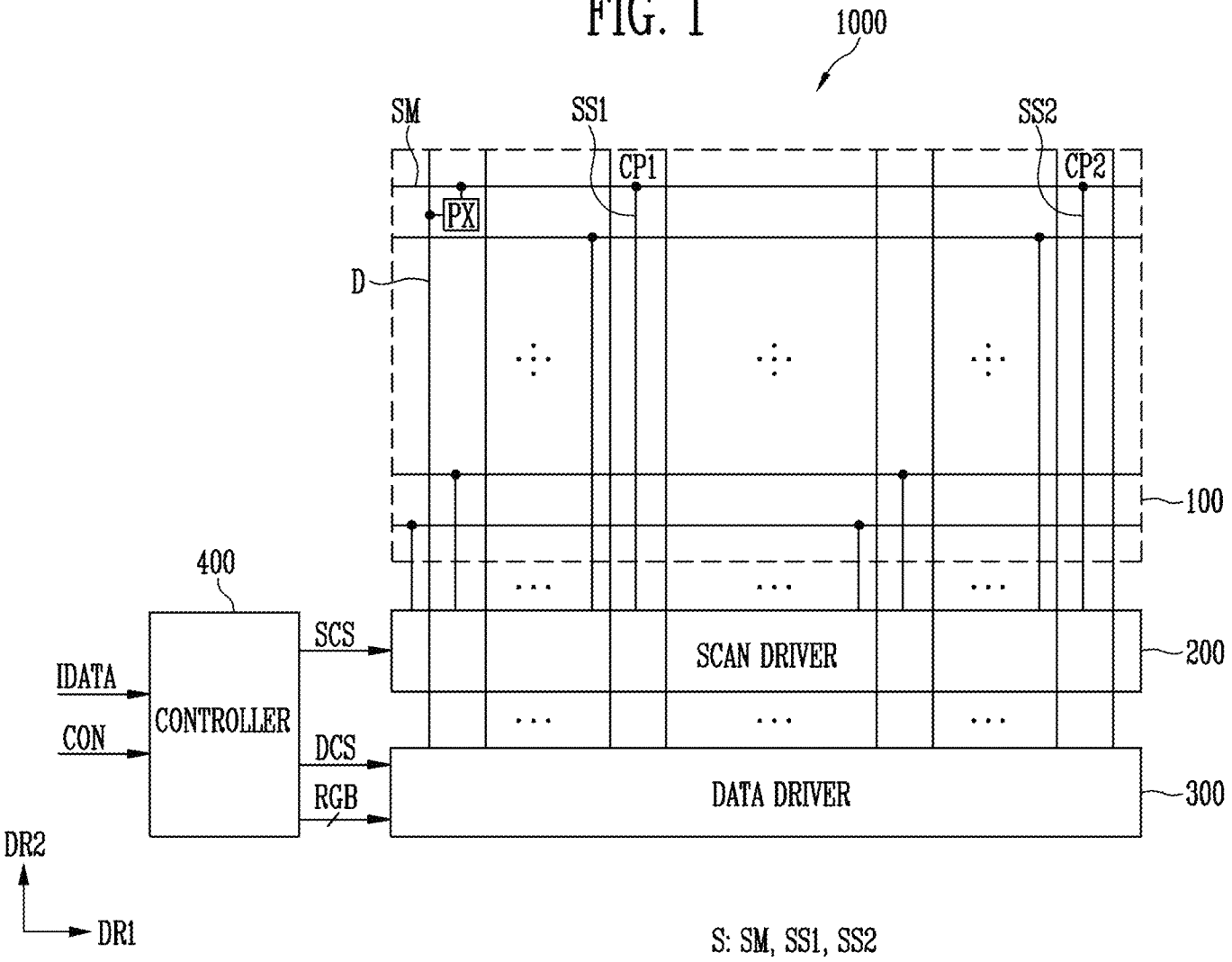
FIG. 1 is a block diagram illustrating a display device according to embodiments of the present invention.

Hereinafter, preferred embodiments of the present invention will be described in detail with reference to the accompanying drawings. The same reference numerals are used for the same components in the drawings, and duplicate descriptions for the same components are omitted. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

FIG. 1 is a block diagram illustrating a display device according to embodiments of the present invention.

Referring to FIG. 1, a display device 1000 may include a pixel unit 100, a scan driver 200, a data driver 300, and a controller 400.

The display device 1000 may be implemented as a self-light emitting display device including a plurality of self-light emitting elements. For example, the display device 1000 may be an organic light emitting display device including organic light emitting elements or a display device including inorganic light emitting elements. However, this is an example, and the display device 1000 may be implemented as a liquid crystal display device, a plasma display device, a quantum dot display device, or the like in another embodiment.

The display device 1000 may be a flat panel display device, a flexible display device, a curved display device, a foldable display device, or a bendable display device. In addition, the display device 1000 may be applied to a transparent display device, a head-mounted display device, a wearable display device, or the like.

The pixel unit 100 may include a plurality of pixels PX connected to scan lines S and data lines D. The display device 1000 according to the present embodiment may be a single side driving type display device 1000 in which the data driver 300 and the scan driver 200 are disposed together on one side of the pixel unit 100. In order to apply the single side driving, each of the scan lines S may include a main scan line SM, a first sub-scan line SS1, and a second sub-scan line SS2.

The main scan line SM may be extended in a first direction DR1 and connected to the pixels PX in a corresponding pixel row. A scan signal may be supplied to the pixels PX through the main scan line SM. That is, each main scan line SM may define a pixel row.

The first sub-scan line SS1 may be extended in a second direction DR2 and connected to the main scan line SM at a first contact point CP1. The second sub-scan line SS2 may be extended in the second direction DR2 and connected to the main scan line SM at a second contact point CP2. In an embodiment, the second direction DR2 may correspond to a pixel column direction.

The first sub-scan line SS1 and the second sub-scan line SS2 may electrically connect the scan driver 200 and the main scan line SM. When a single sub-scan line is connected to the main scan line SM, a deviation of a resistor-capacitor ("RC") load (i.e., RC delay) between a portion close to a contact point and a portion far from the contact point may increase. In order to reduce the deviation of the RC load, the main scan line SM may be connected to the first sub-scan line SS1 and the second sub-scan line SS2 spaced apart from the first sub-scan line SS1 like the embodiment according to the invention. That is, the scan signal may be supplied to the main scan line SM through the first contact point CP1 and the second contact point CP2. Therefore, the deviation of the RC load for each position within the main scan line SM can be relatively reduced.

In an embodiment, first sub-scan lines SS1 may be connected to main scan lines SM in a one-to-one manner, and second sub-scan lines SS2 may also be connected to the main scan lines SM in a one-to-one manner. As shown in FIG. 1, the first sub-scan lines SS1 and the second sub-scan lines SS2 may be arranged to gradually increase in length measured in the second direction DR2 toward the first direction DR1.

The data lines D may be connected to the pixels PX in units of pixel columns.

The scan driver 200 may receive a first control signal SCS from the controller 400. The scan driver 200 may supply scan signals to the scan lines S including an i-th scan line Si in response to the first control signal SCS. The first control signal SCS may include a scan start signal for the scan signals and a plurality of clock signals.

The scan signal may be set to a gate-on level (i.e., low voltage or high voltage) corresponding to the type of a transistor to which the scan signal is supplied.

The data driver 300 may receive a second control signal DCS from the controller 400. The data driver 300 may convert image data RGB into analog data signals (i.e., data voltages) in response to the second control signal DCS and supply the data signals to the data lines D. In addition, a slew rate and/or output timing of the data signals output from the data driver 300 may be adjusted under the control of the controller 400.

The controller 400 may receive an input control signal CON and input image data IDATA from an image source such as an external graphic device. The controller 400 may generate the image data RGB suitable for the operating condition of the pixel unit 100 based on the input image data IDATA and provide the generated image data RGB to the data driver 300.

In an embodiment, the controller 400 may generate the first control signal SCS for controlling the driving timing of the scan driver 200 and the second control signal DCS for controlling the driving timing of the data driver 300 based on the input control signal CON, and provide the first control signal SCS and the second control signal DCS to the scan driver 200 and the data driver 300, respectively.

The controller 400 may adjust the slew rate of the data signals according to a position of a scan line S to which the scan signal is supplied. That is, the scan signals may be sequentially supplied to the scan lines S, and the controller 400 may determine the position of the scan line S to which the scan signal is supplied and may control the data driver 300 to output the data signals synchronized with a timing at which the corresponding scan signal is supplied at the slew rate to which a predetermined weight (or compensation value) is applied.

In an embodiment, for example, in order to control the slew rate of the data signals, the controller 400 may adjust an over-driving pulse applied to the data signals. Alternatively, in order to control the slew rate of the data signals, the controller 400 may adjust the magnitude of a bias current (or bias voltage) for controlling the driving of an output buffer of the data driver 300.

In an embodiment, the controller 400 may control the data driver 300 so that the data signals are supplied to predetermined data lines D at different output timings according to the position of the scan line S to which the scan signal is supplied and the position of a pixel PX connected to the scan line S.

Each pixel PX may be charged with a data voltage corresponding to a data signal supplied from the data driver 300. Here, a predetermined time may be required for the data voltage to be charged to a specific voltage level, and the data voltage is required to be charged within one horizontal time (1 H time) during which the scan signal is applied.

However, when a time point at which the scan signal is supplied to each pixel PX arranged in one pixel row and time points at which the data signals of a plurality of pixel columns corresponding to the one pixel row are supplied are different from each other, a deviation in data charging rate may occur.

In the wiring structure of the pixel unit 100 as shown in FIG. 1, depending on distances to the first contact point CP1 and the second contact point CP2 in one pixel row, the time during which the scan signal is transmitted to the pixels PX in the pixel row may vary depending on the RC load.

As a result, the data charging rate between the pixels may be non-uniform, and display quality may deteriorate.

That is, in the main scan line SM of one scan line S, since the RC load (or equivalent impedance) is different for each position, the controller 400 may adaptively control output timings of the data signals by reflecting the deviation of the RC load. In addition, the controller 400 may adaptively control the slew rate (e.g., the over-driving pulse, and the like) of the data signals in consideration of the deviation of the RC load of the data lines D in the second direction DR2.

In FIG. 1, the scan driver 200, the data driver 300, and the controller 400 are shown to have different configurations, but at least some of the scan driver 200, the data driver 300, and the controller 400 may be integrated into one module or an integrated circuit ("IC") chip in another embodiment. In another embodiment, at least some components and/or functions of the controller 400 may be included in the data driver 300. For example, the data driver 300 and the controller 400 may be included in one source IC.

In addition, the scan driver 200 may be configured with a plurality of scan drivers for driving partial areas of the pixel unit 100, respectively. Likewise, the data driver 300 may be configured with a plurality of data drivers for driving the partial areas of the pixel unit 100, respectively.

Figure 2:
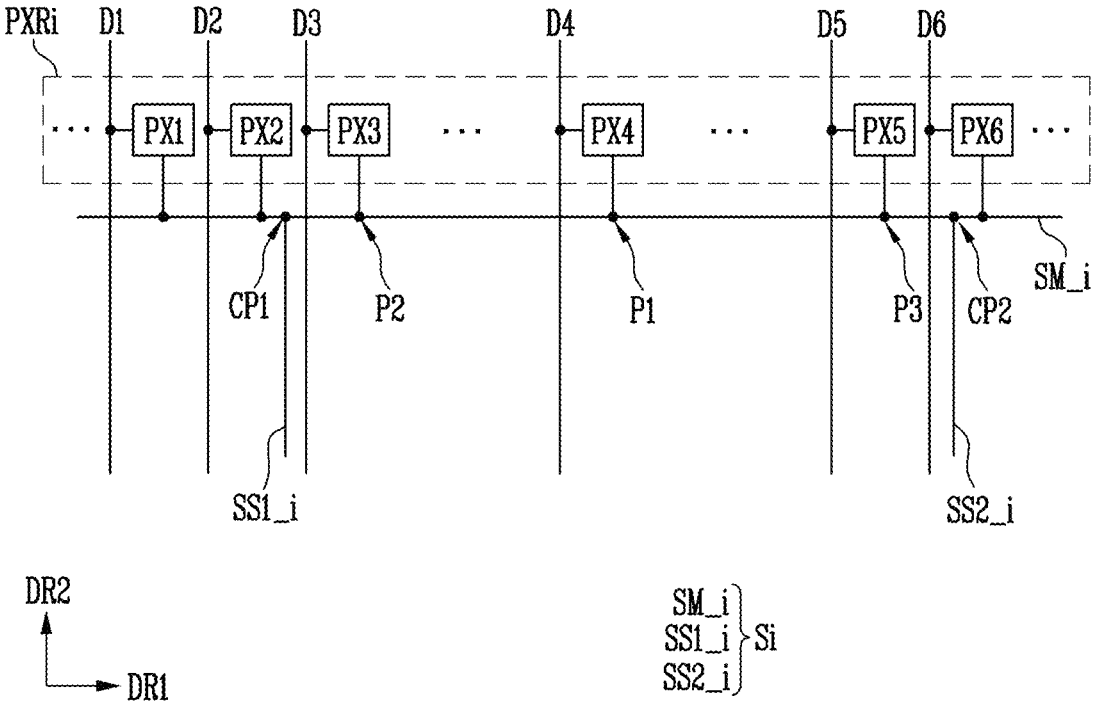
FIG. 2 is a diagram illustrating an example of a scan line and data lines connected to a pixel row included in the display device of FIG. 1.

FIG. 2 is a diagram illustrating an example of a scan line and data lines connected to a pixel row included in the display device of FIG. 1.

Referring to FIG. 2, an i-th pixel row PXRi may be connected to the i-th scan line Si, where i may be a natural number.

In an embodiment, the i-th scan line Si may include a main scan line SM_*i*, a first sub-scan line SS1_*i*, and a second sub-scan line SS2_*i*. A scan signal supplied to the first sub-scan line SS1_*i* and the second sub-scan line SS2_*i* may be supplied to first to sixth pixels PX1 to PX6 of the i-th pixel row PXRi through the main scan line SM_*i*.

Each of the first to sixth pixels PX1 to PX6 may be connected to first to sixth data lines D1 to D6. When the scan signal is supplied to the i-th scan line Si, data signals may be written to the first to sixth pixels PX1 to PX6 through the first to sixth data lines D1 to D6, respectively.

The scan signal may be transmitted to the main scan line SM_*i* through the first sub-scan line SS1_*i*, and supplied from the first contact point CP1 to both directions of the main scan line SM_*i*. Similarly, the scan signal may be transmitted to the main scan line SM_*i* through the second sub-scan line SS2_*i*, and supplied from the second contact point CP2 to both directions of the main scan line SM_*i*.

At this time, the RC load (hereinafter, referred to as a load) seen by the main scan line SM_*i* and the pixels PX1 to PX6 connected thereto may increase as the distance from the first contact point CP1 increases. Also, the load may increase as the distance from the second contact point CP2 increases. For example, in an area between the first contact point CP1 and the second contact point CP2, the load at a first position P1 corresponding to an intermediate point between the first contact point CP1 and the second contact point CP2 may be the greatest of the loads at positions between the first contact point CP1 and the second contact point CP2 (e.g., the positions P1, P2 and P3).

In other words, a waveform of the scan signal supplied to a fourth pixel PX4 corresponding to the first position P1 may be more affected by the load than each of waveforms of the scan signal supplied to a second pixel PX2 close to the first contact point CP1 and a sixth pixel PX6 close to the second contact point CP2. For example, the slew rate of the scan signal supplied to the fourth pixel PX4 may be lower than the slew rate of the scan signal supplied to the second pixel PX2 and the sixth pixel PX6.

Likewise, each of the load of the scan line Si at a second position P2 (a third pixel PX3) and a third position P3 (a fifth pixel PX5) may be smaller than the load of the scan line Si at the first position P1.

The load of the scan line Si may increase toward the left side (that is, an opposite direction to the first direction DR1) from the first contact point CP1, and the load of the scan line Si may increase toward the right side (that is, the first direction DR1) from the second contact point CP2.

Figure 3A:
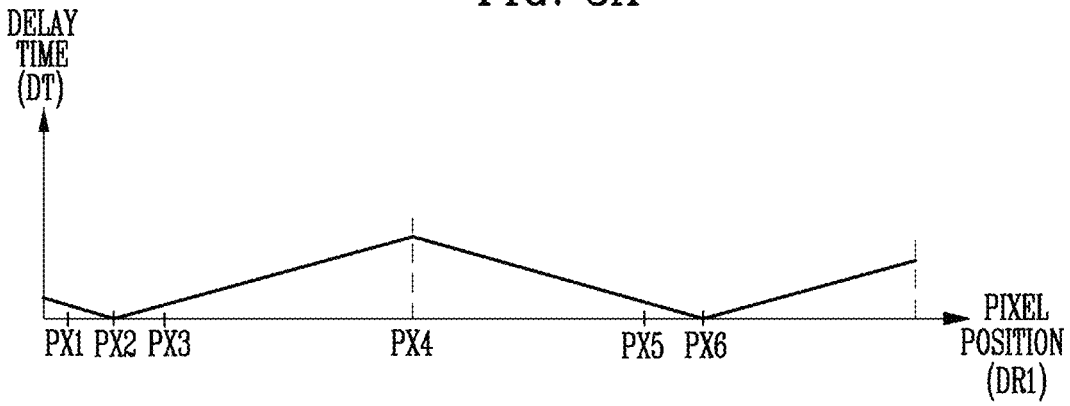
FIG. 3A is a timing diagram illustrating an example of supply delay times of data signals supplied to pixels in the pixel row of FIG. 2.

FIG. 3A is a timing diagram illustrating an example of supply delay times of data signals supplied to pixels in the pixel row of FIG. 2.

Referring to FIGS. 1, 2 and 3A, the controller 400 may adjust the output timing of the data signals according to a position in the first direction DR1 of a target pixel connected to the main scan line SM_*i*.

The graph of FIG. 3A shows a delay time DT of the data signal supplied to each pixel according to a pixel position in the first direction DR1 with respect to the i-th pixel row PXRi of FIG. 2.

In an embodiment, the controller 400 may adjust the output timing of the data signals based on the distance between the target pixel and the first contact point CP1 and the distance between the target pixel and the second contact point CP2. In other words, the controller 400 may further delay the output timing of the data signal as the load of the main scan line SM_*i* increases.

As shown in FIG. 3A, each of the loads at a position corresponding to the second pixel PX2 closest to the first contact point CP1 and a position corresponding to the sixth pixel PX6 closest to the second contact point CP2 may be the smallest, and the load at a position corresponding to the fourth pixel PX4 may be the largest.

When the scan signal is supplied to the main scan line SM_*i*, the output timings of the data signals for the same grayscale may be faster as the data lines D1 to D6 are closer from the fourth pixel PX4 to the first contact point CP1 or the second contact point CP2. For example, the output timing of the data signal supplied to the second pixel PX2 may be faster than the output timing of the data signal supplied to the third pixel PX3. Also, the output timing of the data signal supplied to the third pixel PX3 may be faster than the output timing of the data signal supplied to the fourth pixel PX4.

In an embodiment, when the scan signal is supplied to the main scan line SM_*i*, the output timings of the data signals for the same grayscale output to the data lines (for example, D1) connected to the pixels (for example, the first pixel PX1) on the left side of the first contact point CP1 may be further delayed as the distance from the first contact point CP1 increases. For example, the output timing of the data signal supplied to the first pixel PX1 may be later than the output timing of the data signal supplied to the second pixel PX2.

Similarly, when the scan signal is supplied to the main scan line SM_*i*, the output timings of the data signals for the same grayscale output to the data lines connected to the pixels on the right side of the second contact point CP2 may be further delayed as the distance from the second contact point CP2 increases.

In other words, the controller 400 may adjust the output delay time DT (or shift amount) of the data signal according to a change in the slew rate of the scan signal according to the position of the pixel in the i-th pixel row PXRi. The lower the slew rate of the scan signal, the more delayed the data signal may be output.

Accordingly, the deviation in charging rate of the data signal of the pixels in the i-th pixel row PXRi can be reduced, and the display quality can be improved.

Figure 3B:
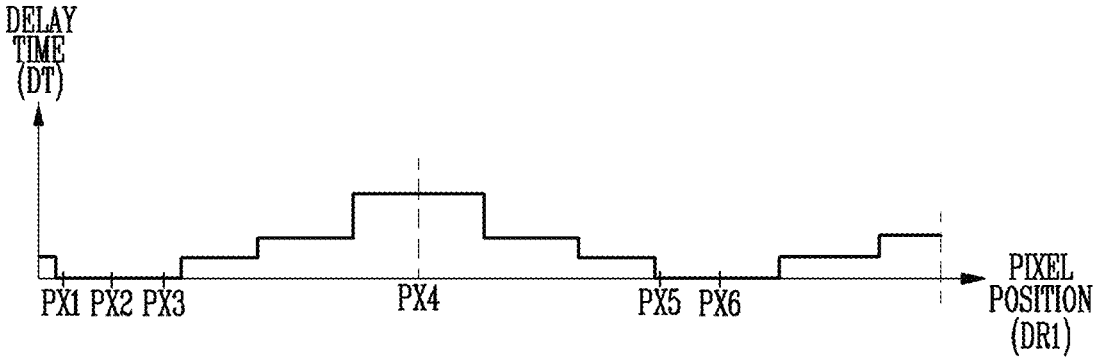
FIG. 3B is a timing diagram illustrating another example of the supply delay times of the data signals supplied to the pixels in the pixel row of FIG. 2.

FIG. 3B is a timing diagram illustrating another example of the supply delay times of the data signals supplied to the pixels in the pixel row of FIG. 2.

In FIG. 3B, the same reference numerals are used for the components described with reference to FIG. 3A, and duplicate descriptions of the components will be omitted.

Referring to FIGS. 1, 2 and 3B, the delay time DT of the data signal may be divided and changed for each predetermined area.

The controller 400 may adjust the output timing of the data signals based on the distance between the target pixel and the first contact point CP1 and the distance between the target pixel and the second contact point CP2 in the first direction DR1. In this case, the delay time DT of the data signal may be set step by step based on the first contact point CP1, the second contact point CP2, and the first position P1. Accordingly, compared to the case of FIG. 3A, driving burden and power consumption of the controller 400 can be reduced.

Figure 4:
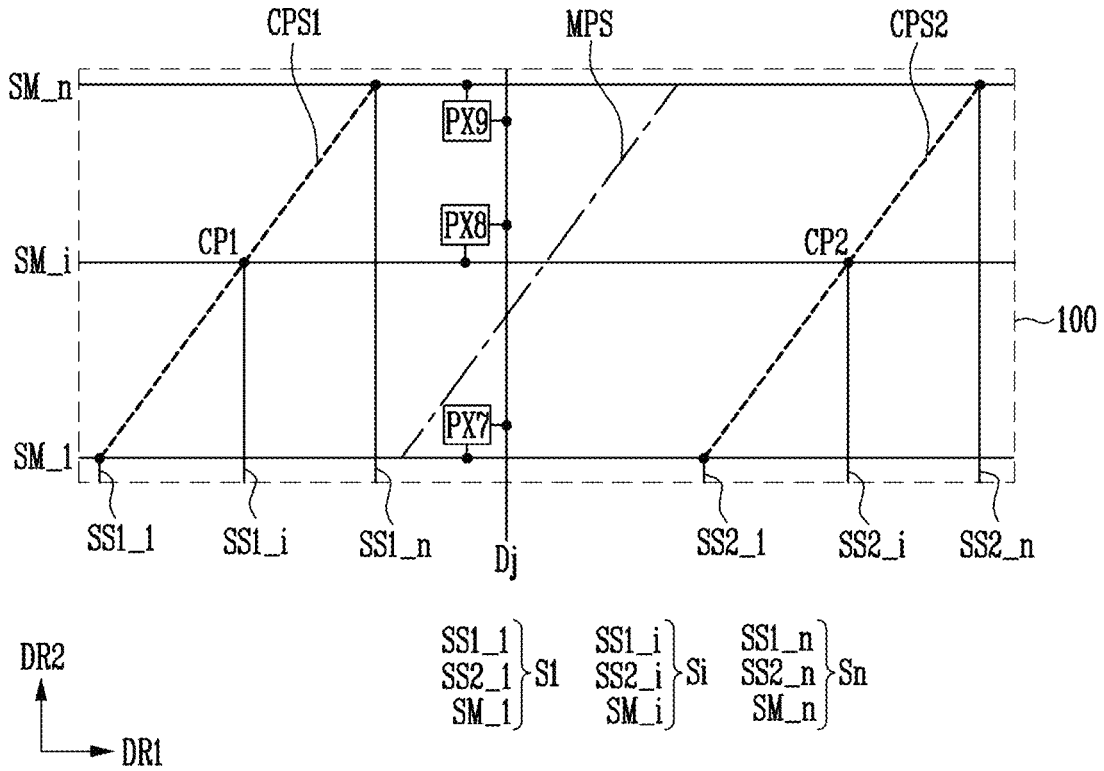
FIG. 4 is a diagram schematically illustrating an example of a pixel unit included in the display device of FIG. 1.

FIG. 4 is a diagram schematically illustrating an example of a pixel unit included in the display device of FIG. 1.

Referring to FIG. 4, scan lines S1 to Sn may include main scan lines SM_1 to SM_*n*, first sub-scan lines SS1_1 to SS1_*n*, and second sub-scan lines SS2_1 to SS2_*n*, respectively, where n may be an integer greater than 1.

The first sub-scan line SS1_*i* of the i-th scan line Si may be connected to the main scan line SM_*i* of the i-th scan line Si through the first contact point CP1, and the second sub-scan line SS2_*i* of the i-th scan line Si may be connected to the main scan line SM_*i* of the i-th scan line Si through the second contact point CP2.

In an embodiment, the first sub-scan lines SS1_1 to SS1_*n* and the second sub-scan lines SS2_1 to SS2_*n* may be arranged to gradually increase in length measured in the second direction DR2 toward the first direction DR1. That is, referring back to FIG. 1, n-th pixel row which is connected to n-th scan line Sn is disposed farthest (i.e., located at the top side of the pixel unit 100) from the data driver 300, and the first pixel row which is connected to the first scan line S1 is disposed nearest (i.e., located at the bottom side of the pixel unit 100) from the data driver 300. FIG. 4 schematically shows an arrangement tendency of first contact points CPS1 to which the first sub-scan lines SS1_1 to SS1_*n* are connected and an arrangement tendency of second contact points CPS2 to which the second sub-scan lines SS2_1 to SS2_*n* are connected. For example, a first sub-scan line SS1_*n* of an n-th scan line Sn may be disposed to the right side of a first sub-scan line SS1_1 of a first scan line S1, and a second sub-scan line SS2_*n* of the n-th scan line Sn may be disposed to the right side of a second sub-scan line SS2_1 of the first scan line S1. According to the arrangement of the first and second contact points CPS1 and CPS2, intermediate points MPS where the load of the scan line is greatest may be determined. Each of the intermediate points MPS may correspond to the first position P1 described with reference to FIG. 2.

As the distance from each of the intermediate points MPS to the first contact points CPS1 or the second contact points CPS2 decreases, the load of the scan line may be decreased and the delay time (shift amount) of the data signal may be decreased.

In an embodiment, the scan signal and the data signal may be supplied from the lower side of the pixel unit 100 in the second direction DR2.

The j-th data line Dj may extends in the second direction DR2 and may constitute a j-th pixel column, where j may be an integer greater than 0. As the distance from the data driver 300 (shown in FIG. 1) increases, the load (i.e., RC load) of the j-th data line Dj may increase. For example, the load of the j-th data line Dj when the scan signal is supplied to an eighth pixel PX8 may be greater than the load of the j-th data line Dj when the scan signal is supplied to a seventh pixel PX7. Similarly, the load of the j-th data line Dj when the scan signal is supplied to a ninth pixel PX9 may be greater than the load of the j-th data line Dj when the scan signal is supplied to the eighth pixel PX8.

Figure 5:
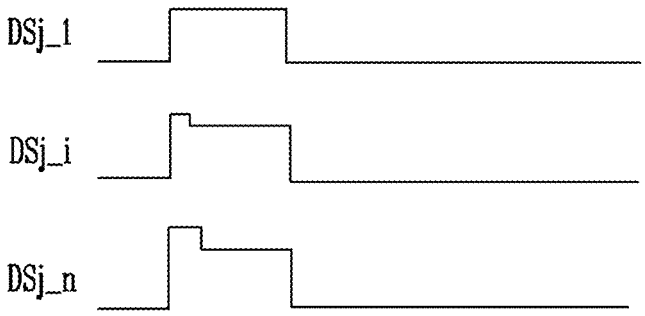
FIG. 5 is a timing diagram illustrating an example of over-drive driving of data signals supplied to pixel columns of the pixel unit of FIG. 4.

FIG. 5 is a timing diagram illustrating an example of over-drive driving of data signals supplied to pixel columns of the pixel unit of FIG. 4.

Referring to FIGS. 1, 4 and 5, the controller 400 may adjust the over-driving pulse of the data signals according to the scan line to which the scan signal is supplied.

The controller 400 may increase at least one of the width (i.e., time duration) of the over-driving pulse and the height (i.e., magnitude) of the over-driving pulse as the load of the j-th data line Dj increases. For example, as the main scan lines SM_1 to SM_*n* to which the scan signal is supplied are further away from the data driver 300, at least one of the width of the over-driving pulse of the data signal and the magnitude of the over-driving pulse of the data signal may be increased.

In an embodiment, for the same grayscale, the width of the over-driving pulse of a data signal DSj_1 supplied to a first pixel row corresponding to the first scan line S1 may be smaller than the width of the over-driving pulse of a data signal DSj_*i* supplied to the i-th pixel row corresponding to the i-th scan line Si, where i may be an integer greater than 1 and less than n, since the length of each of the first sub-scan line SS1 and second sub-scan line SS2 for the first scan line S1 is smaller than the length of each of the first sub-scan line SS1 and second sub-scan line SS2 for the i-th scan line Si. The height of the over-driving pulse of the data signal DSj_1 supplied to the first pixel row may be smaller than the height of the over-driving pulse of the data signal DSj_i supplied to the i-th pixel row.

Likewise, the width and/or height of the over-driving pulse of the data signal DSj_*i* supplied to the i-th pixel row may be smaller than the width and/or height of the over-driving pulse of a data signal DSj_*n* supplied to an n-th pixel row.

Accordingly, the deviation in data charging rate in the second direction DR2 can be reduced by reducing a change in waveform of the data signal due to the RC delay of the load of the data line.

Figure 6:
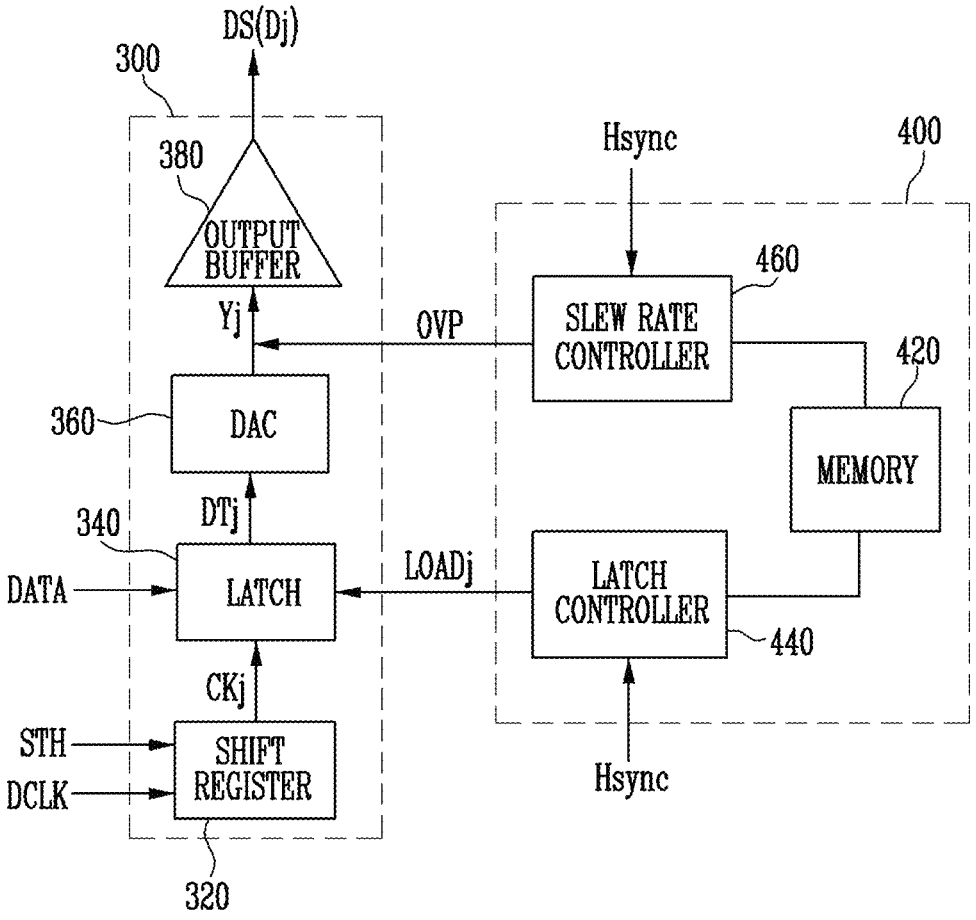
FIG. 6 is a block diagram illustrating an example of a data driver and a controller included in the display device of FIG. 1.
Figure 7:
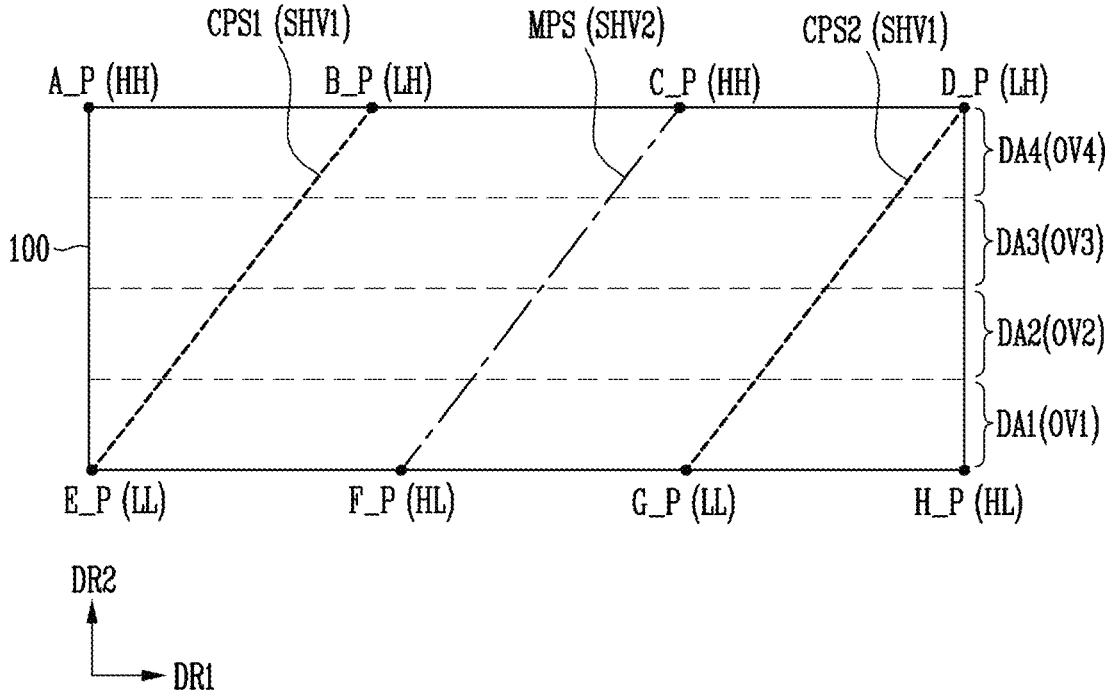
FIG. 7 is a diagram for explaining an operation of the controller of FIG. 6.

FIG. 6 is a block diagram illustrating an example of a data driver and a controller included in the display device of FIG. 1. FIG. 7 is a diagram for explaining an operation of the controller of FIG. 6.

Referring to FIGS. 1, 4, 6 and 7, the controller 400 may control the slew rate and output timing of the data signal based on the load of the scan lines and the load of the data lines.

The data driver 300 may include a shift register 320, a latch 340, a digital-to-analog converter 360, and an output buffer 380.

The shift register 320 may control a timing at which image data DATA is sequentially stored in the latch 340. For example, the shift register 320 may include m shift circuits corresponding to the number of the data lines, where m may be an integer greater than 1.

In FIG. 6, for convenience of description, only a partial configuration of the data driver 300 for driving the j-th data line Dj and only a partial configuration of the controller 400 are shown. The driving of the j-th data line Dj will be mainly described.

The shift register 320 may receive a start signal STH and a data clock signal DCLK from the controller 400. The shift register 320 may generate shifted clock signals, for example, latch clock signals, by shifting the start signal STH in synchronization with the data clock signal DCLK. A latch clock signal CKj corresponding to the j-th data line Dj may be provided to the latch 340.

The latch 340 may latch the image data DATA and simultaneously output the image data DATA in units of horizontal lines (or units of pixel rows). The latch 340 may be composed of m latch circuits. In an embodiment, the latch 340 may sequentially store the image data DATA corresponding to one horizontal line from one end of the latch circuit to the other end based on the latch clock signals. When the storage of the image data DATA is completed, the latch 340 may output the latched image data in units of horizontal lines in response to a load signal. The image data corresponding to one horizontal line may be N-bit data (for example, N may be 8).

In FIG. 6, latched image data DTj corresponding to the j-th data line Dj is shown. For example, the latched image data DTj may be output to the digital-to-analog converter 360 in response to a j-th load signal LOADj supplied from the controller 400. That is, the output timing of a data signal DS output to the j-th data line Dj may be determined according to the output timing of the j-th load signal LOADj.

In an embodiment, the latch 340 may include a sampling latch and a holding latch. For example, the latch 340 may include m sampling latches for storing m digital image data DATA, respectively. Each sampling latch may have a storage capacity corresponding to the number of bits of the image data DATA, and may sequentially store the image data DATA in response to sampling signals.

In an embodiment, m holding latches simultaneously receive and store the latched image data from the sampling latches, and supply the latched image data stored in a previous period to the digital-to-analog converter 360 based on load signals. For example, a j-th holding latch may supply the latched image data DTj to the digital-to-analog converter 360 in response to the j-th load signal LOADj.

That is, output timings of the image data corresponding to one pixel row (horizontal line) may be different according to the load signal.

The digital-to-analog converter 360 may convert the latched image data DTj into an output signal Yj having an analog type based on gamma voltages. The output signal Yj may be supplied to the output buffer 380.

The output buffer 380 may output the output signal Yj output from the digital-to-analog converter 360 to the j-th data line Dj. For example, the output buffer 380 may be driven by a predetermined bias voltage and a clock signal, and may output the data signal DS to the j-th data line Dj.

In an embodiment, the output buffer 380 may receive an over-driving pulse OVP generated by the controller 400. The output buffer 380 may output the data signal DS in which the output signal Yj and the over-driving pulse OVP are combined to the j-th data line Dj.

The controller 400 may include a memory 420, a latch controller 440, and a slew rate controller 460. Hereinafter, the configuration and operation of the controller 400 will be described with reference to FIG. 7. In an embodiment, as shown in FIG. 6, the slew rate controller 460 may control the over-driving pulse of the data signal.

Over-driving values OV1 to OV4 and shift values SHV1 and SHV2 corresponding to predetermined points of the pixel unit 100 may be stored in the memory 420. For example, as shown in FIG. 7, shift values of points (for example, A_P, C_P, F_P, and H_P) where the load of the scan line (hereinafter, scan load) is the largest and points (for example, B_P, D_P, E_P, and G_P) where the load of the scan line is the smallest based on a horizontal direction, and shift values of points (A_P, B_P, C_P, and D_P) where the load of the data line (hereinafter, data load) is the largest and points (E_P, F_P, G_P, and H_P) where the load of the data line is the smallest based on a vertical direction may be stored in the memory 420. In addition, the over-driving values OV1 to OV4 may correspond to each of predetermined areas DA1 to DA4 of the pixel unit 100.

For example, a point A (A_P), a point B (B_P), a point C (C_P), and a point D (D_P) may have the largest data load, and a point E (E_P), a point F (F_P), a point G (G_P), and a point H (H_P) may have the smallest data load. That is, the data load at a point furthest from the data driver may be the largest, and the data load at a point closest to the data driver may be the smallest.

The closer to the first contact points CPS1 or the second contact points CPS2, the smaller the scan load may be, and the closer to the intermediate points MPS, the larger the scan load may be. For example, the point B (B_P), the point D (D_P), the point E (E_P), and the point G (G_P) may have the smallest scan load, and the point A (A_P), the point C (C_P), the point F (F_P) and the point H (H_P) may have the largest scan load.

In this way, one data of a first load HH, a second load LH, a third load HL, and a fourth load LL may be set with respect to the eight points (A_P, B_P, C_P, D_P, E_P, F_P, G_P, and H_P) according to the scan load and a data load.

The first load HH may mean a maximum scan load and a maximum data load, and a shift value and an over-driving value may be set to the largest values. The larger the shift value, the larger the output delay time of the data signal, and the larger the over-driving value, the larger the width and/or height of the over-driving pulse of the data signal.

The second load LH may mean a minimum scan load and the maximum data load. For example, the second load LH may correspond to the point B (B_P) and the point D (D_P).

The third load HL may mean the maximum scan load and a minimum data load. For example, the third load HL may correspond to the point F (F_P) and the point H (H_P).

The fourth load LL may mean the minimum scan load and the minimum data load. For example, the fourth load LL may correspond to the point E (E_P) and the point G (G_P).

In an embodiment, the over-driving value according to the data load may be set to a different value according to the second direction DR2. For example, the pixel unit 100 may be divided into first to fourth areas DA1 to DA4 corresponding to first to fourth over-driving values OV1 to OV4, respectively. When the data signal is written to the pixel row included in a first area DA1, a first over-driving value OV1 may be read from the memory 420. According to an embodiment, in terms of reducing power consumption, the over-driving pulse may not be applied to the data signal to which the first over-driving value OV1 is applied.

In an embodiment, the shift value according to the scan load may be set according to the first contact points CPS1, the second contact points CPS2, and the intermediate points MPS. For example, a first shift value SHV1 may correspond to the first contact points CPS1 and the second contact points CPS2, and a second shift value SHV2 may correspond to the intermediate points MPS. The second shift value SHV2 may correspond to the point A (A_P) and the point H (H_P) where the scan load is the largest.

The first shift value SHV1 may correspond to a minimum delay time (or minimum shift amount) of the data signal, and the second shift value SHV2 may correspond to a maximum delay time (or maximum shift amount) of the data signal.

According to an embodiment, the data signal to which the first shift value SHV1 is applied may be output to the data line without delay.

The slew rate controller 460 may generate the over-driving pulse OVP of the data signal supplied to the target pixel based on a position of the main scan line to which the target pixel is connected and the over-driving values OV1 to OV4.

In an embodiment, the slew rate controller 460 may determine the position of the main scan line (that is, the pixel row of the target pixel) based on a horizontal synchronization signal Hsync. The horizontal synchronization signal Hsync may be supplied in units of pixel rows (or horizontal lines). The slew rate controller 460 may detect a target pixel row including the target pixel by counting an input of the horizontal synchronization signal Hsync.

The slew rate controller 460 may determine an area including the target pixel row from the first to fourth areas DA1 to DA4 and read the over-driving value corresponding to the area from the memory 420. The slew rate controller 460 may generate the over-driving pulse OVP using the read over-driving value.

In an embodiment, when the target pixel row is included in the first area DA1, the slew rate controller 460 may not generate the over-driving pulse OVP.

The latch controller 440 may control the output timing of the latched image data DTj of the latch 340 based on the position of the target pixel on the main scan line and the shift values SHV1 and SHV2. In an embodiment, the latch controller 440 may detect the target pixel row including the target pixel by counting the input of the horizontal synchronization signal Hsync. The latch controller 440 may calculate the shift value based on a positional relationship between the first contact point CP1, the second contact point CP2, and an intermediate point MP of the target pixel row, and the target pixel.

For example, when the target pixel is between the first contact point CP1 and the intermediate point MP, the first shift value SHV1 corresponding to the first contact point CP1 and the second shift value SHV2 corresponding to the intermediate point MP may be interpolated to calculate the shift value corresponding to the target pixel.

In order to reduce power consumption and computational complexity, the shift value calculated by such interpolation may be changed at intervals of a predetermined range of the target pixel row.

The latch controller 440 may generate the j-th load signal LOADj using the calculated shift value. The j-th load signal LOADj may control a timing when the latched image data DTj is provided to the digital-to-analog converter 360. Accordingly, the output timing (i.e., delay time) of the data signal DS may be adjusted.

As described above, the display device according to the embodiments of the present invention may differently control the slew rate of the data signal and/or the output timing (i.e., output delay time) of the data signal according to the position of the pixel in the pixel unit 100 in consideration of the scan load and the data load in the single side driving type display device. Accordingly, the deviation in charging rate of the data signal of the pixels can be reduced, and the display quality can be improved.

FIGS. 8A to 8D are diagrams illustrating examples of operations of the controller of FIG. 6.

Referring to FIGS. 6, 7, 8A to 8D, the slew rate and output timing of the data signal DS may be controlled according to the load corresponding to the pixel.

Figure 8A:
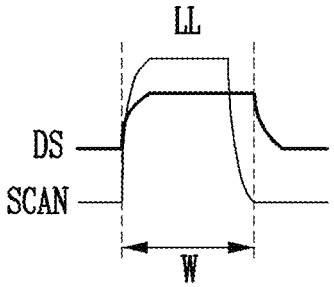
FIGS. 8A to 8D are diagrams illustrating examples of operations of the controller of FIG. 6.

As shown in FIG. 8A, when a scan signal SCAN is supplied to a pixel (for example, a pixel at the point E (E_P) and/or the point G (G_P)) corresponding to the fourth load LL, an influence of the load on the data signal DS and the scan signal may be weak. Therefore, the output of the data signal DS may not be shifted (delayed), and the over-driving pulse may not be applied. For example, a period between a time point at which the rising of the scan signal SCAN starts and a time point at which the falling of the scan signal SCAN ends may be defined as a first width W. In this case, the supply of the data signal DS may start at a time point substantially the same as the time point at which the rising of the scan signal SCAN starts (for example, corresponds to a time point at which the rising of the data signal DS starts), and may end at a time point substantially the same as the time point at which the falling of the scan signal SCAN ends.

Figure 8B:
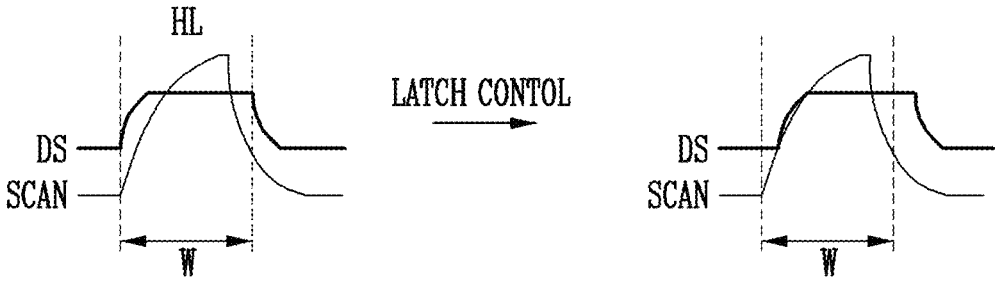

As shown in FIG. 8B, when the scan signal SCAN is supplied to a pixel (for example, a pixel at the point F (F_P) and the point H (H_P)) corresponding to the third load HL, the output of the scan signal SCAN may be delayed and the output time of the scan signal SCAN may be shortened due to a large scan load. For example, the period between the time point at which the rising of the scan signal SCAN starts and the time point at which the falling of the scan signal SCAN ends may be greater than the first width W.

In this case, the output of the data signal DS may be delayed by the driving of the latch controller 440 of the controller 400. Accordingly, the charging rate of the data signal DS for the pixel corresponding to the third load HL can be sufficiently secured.

Figure 8C:
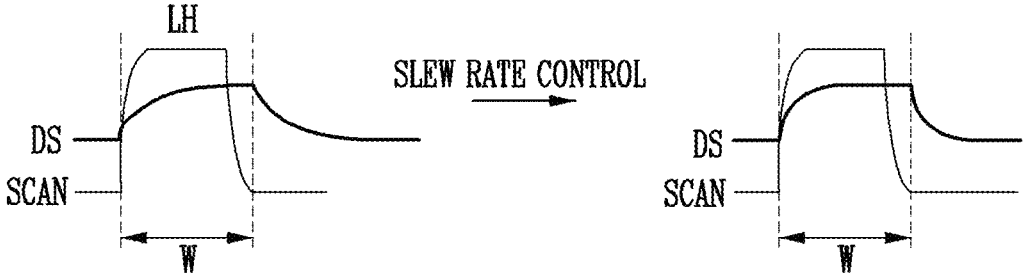

As shown in FIG. 8C, when the scan signal SCAN is supplied to a pixel (for example, a pixel at the point B (B_P) and the point D (D_P)) corresponding to the second load LH, the output of the data signal DS may be delayed due to a large data load. That is, a time point until the data signal DS reaches a target level may be delayed, so that the charging rate of the data signal DS may be decreased.

In this case, the slew rate of the data signal DS may be increased by the driving of the slew rate controller 460 of the controller 400. Accordingly, the charging rate of the data signal DS for the pixel corresponding to the second load LH can be sufficiently secured.

Figure 8D:
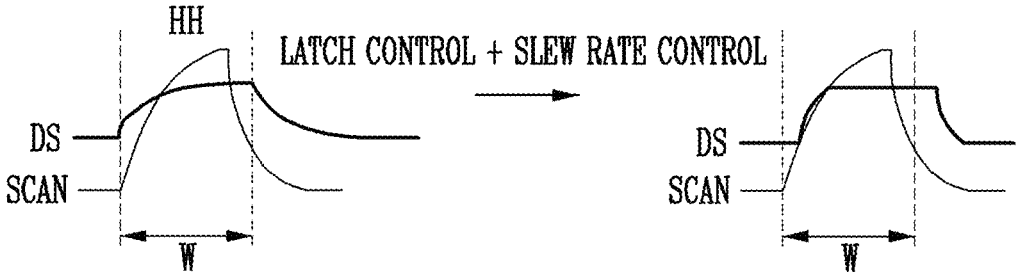

As shown in FIG. 8D, when the scan signal SCAN is supplied to a pixel (for example, a pixel at the point A (A_P) and the point C (C_P)) corresponding to the first load HH, both the data signal DS and the scan signal SCAN may be delayed. In this case, the data signal DS may be controlled by the operation of the slew rate controller 460 and the latch controller 440. For example, as the slew rate of the data signal DS increases, the output may be delayed (i.e., shifted).

Accordingly, since the data signal DS may be supplied in synchronization with the scan signal SCAN, the charging rate of the data signal DS for the pixel corresponding to the first load HH can be sufficiently secured.

Figure 9A:
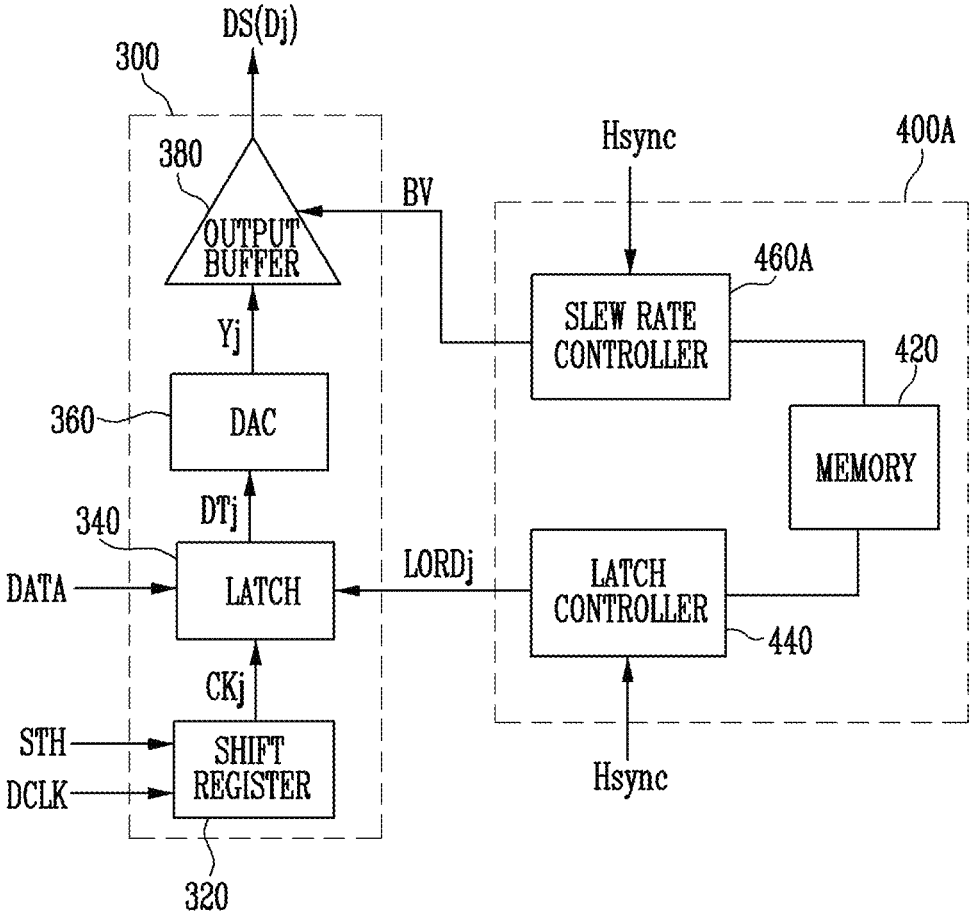
FIG. 9A is a block diagram for explaining another example of the controller of FIG. 6.
Figure 9B:
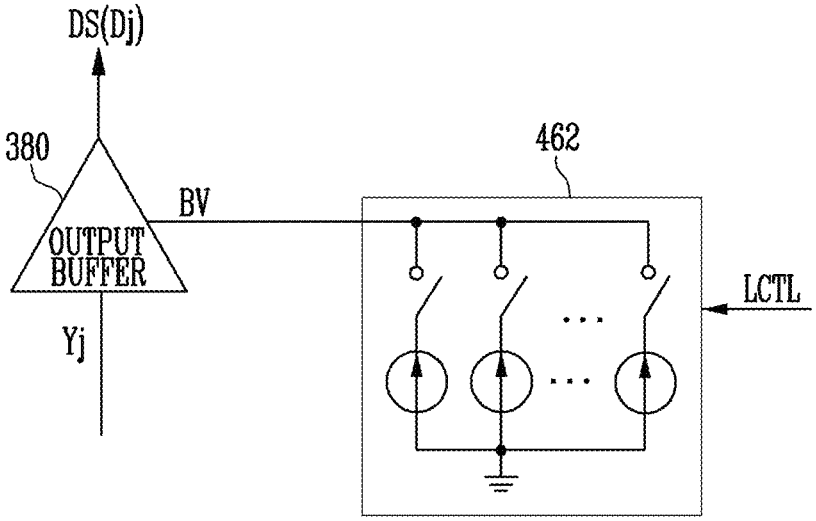
FIG. 9B is a diagram illustrating an example of a partial configuration of a slew rate controller included in the controller of FIG. 9A.

FIG. 9A is a block diagram for explaining another example of the controller of FIG. 6. FIG. 9B is a diagram illustrating an example of a partial configuration of a slew rate controller included in the controller of FIG. 9A.

In FIG. 9A, the same reference numerals are used for the same or similar components described with reference to FIG. 6, and redundant descriptions will be omitted. In addition, a controller 400A of FIG. 9A may have a configuration substantially the same as or similar to the controller 400 of FIG. 6 except for a configuration in which a slew rate controller 460A controls a bias voltage BV.

Referring to FIG. 9A, the controller 400A may control the slew rate and output timing of the data signal based on the load of the scan lines and the load of the data lines.

In an embodiment, bias values may be set in the memory 420 by replacing the over-driving values.

In an embodiment, the slew rate controller 460A may adjust the bias voltage BV (or a bias current) supplied to the output buffer 380. The output buffer 380 may be implemented as an operational amplifier. The bias voltage BV may serve as a power source for driving the operational amplifier. Due to the characteristics of the output buffer 380 implemented as the operational amplifier, the slew rate of the data signal DS may vary according to the bias voltage BV. For example, for the same grayscale, as the bias voltage BV increases, the slew rate of the data signal DS may increase.

Accordingly, the slew rate controller 460A may increase the bias voltage BV as the data load increases.

The slew rate controller 460A may adjust the bias voltage BV supplied to the output buffer corresponding to the target pixel based on the position of the main scan line to which the target pixel is connected and the bias values.

The slew rate controller 460A may determine an area including the target pixel row from the first to fourth areas DA1 to DA4 and derive a bias value corresponding to the area from the memory 420. The slew rate controller 460A may adjust the magnitude of the bias voltage BV using the derived bias value.

In an embodiment, as shown in FIG. 9B, the slew rate controller 460A may include a bias voltage generator 462. The bias voltage generator 462 may include a plurality of current sources connected in parallel and switches for controlling the connection thereof. The slew rate controller 460A may generate a current source control signal LCTL for controlling the switches based on the bias value. The operation of the switches may be controlled by the current source control signal LCTL.

In an embodiment, for example, as the data load decreases, the number of switches to be turned on decreases, so that the bias voltage BV may decrease.

The output buffer 380 may adjust the slew rate of the output signal Yj based on the bias voltage BV.

By the operation of the controller 400A as described above, the data signal DS may be output as the waveforms shown in FIGS. 8A to 8D according to the position of the pixel.

Figure 10:
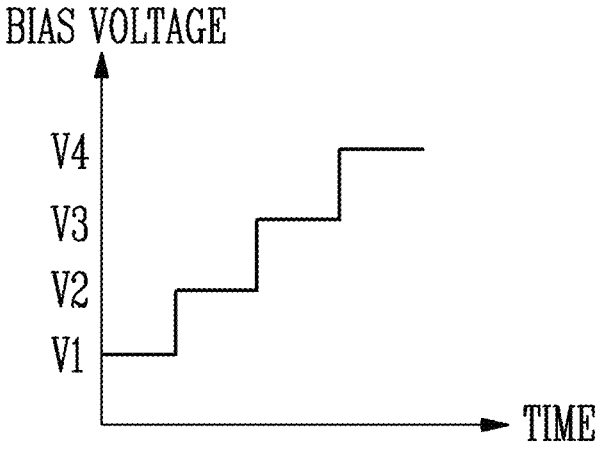
FIG. 10 is a diagram for explaining an example of outputting a bias voltage according to an operation of the slew rate controller of FIG. 9B.

FIG. 10 is a diagram for explaining an example of outputting a bias voltage according to an operation of the slew rate controller of FIG. 9B.

Referring to FIGS. 7, 9A, 9B and 10, the slew rate controller 460A may increase the magnitude of the bias voltage BV step by step as time elapses within one frame period.

As time elapses, the scan signals may be sequentially supplied to the scan lines. For example, when the data signal DS is supplied to the first area DA1, the bias voltage BV may have a first voltage level V1, and when the data signal DS is supplied to the second area DA2, the bias voltage BV may have a second voltage level V2. Similarly, when the data signal DS is supplied to the third area DA3, the bias voltage BV may have a third voltage level V3, and when the data signal DS is supplied to the fourth area DA4, the bias voltage BV may have a fourth voltage level V4.

Accordingly, as the data load increases, the slew rate of the data signal DS may increase.

As described above, the display device according to the embodiments of the present invention may differently control the slew rate of the data signal and/or the output timing (i.e., output delay time) of the data signal according to the position of the pixel in the pixel unit 100 in consideration of the scan load (i.e., RC load of the scan line) and the data load (i.e., RC load of the data line) in the single side driving type display device. Accordingly, the deviation in charging rate of the data signal of the pixels can be reduced, and the display quality can be improved.

However, effects of the present invention are not limited to the above-described effects, and may be variously extended without departing from the spirit and scope of the present invention.

As described above, preferred embodiments of the present invention have been described with reference to the drawings. However, those skilled in the art will appreciate that various modifications and changes can be made to the present invention without departing from the spirit and scope of the invention as set forth in the appended claims.

What is claimed is:

1. A display device comprising:

a pixel unit including pixels connected to data lines and scan lines;

a data driver disposed on one side of the pixel unit to drive the data lines;

a scan driver disposed on the one side of the pixel unit together with the data driver to drive the scan lines; and a controller which controls a slew rate and output timing of data signals output to the data lines based on a load of the scan lines and a load of the data lines, wherein each of the scan lines comprises:

a main scan line extending in a first direction and connected to pixels in a corresponding pixel row;

a first sub-scan line extending in a second direction different from the first direction and connected to the main scan line at a first contact point; and a second sub-scan line extending in the second direction and connected to the main scan line at a second contact point.

2. The display device of claim 1, wherein the controller adjusts an over-driving pulse of the data signals according to a scan line to which a scan signal is supplied among the scan lines.

3. The display device of claim 2, wherein for a same grayscale, a width of the over-driving pulse of the data signals supplied to a first pixel row corresponding to a first scan line of the scan lines is smaller than a width of the over-driving pulse of the data signals supplied to a second pixel row corresponding to a second scan line of the scan lines, and wherein the main scan line of the first scan line and the first pixel row each are closer to the data driver than each of the main scan line of the second scan line and the second pixel row.

4. The display device of claim 2, wherein for a same grayscale, a height of the over-driving pulse of the data signals supplied to a first pixel row corresponding to a first scan line of the scan lines is smaller than a height of the over-driving pulse of the data signals supplied to a second pixel row corresponding to a second scan line of the scan lines, and wherein the main scan line of the first scan line and the first pixel row each are closer to the data driver than each of the main scan line of the second scan line and the second pixel row.

5. The display device of claim 2, wherein the controller increases at least one of a width of the over-driving pulse and a height of the over-driving pulse as the load of the data lines increases.

6. The display device of claim 5, wherein at least one of the width of the over-driving pulse and the height of the over-driving pulse increases as the main scan line to which the scan signal is supplied is further away from the data driver.

7. The display device of claim 2, wherein the controller adjusts the output timing of the data signals for each of the scan lines according to a position of a target pixel connected to the main scan line.

8. The display device of claim 7, wherein the controller adjusts the output timing of the data signals based on a distance between the target pixel and the first contact point and a distance between the target pixel and the second contact point.

9. The display device of claim 8, wherein for a same grayscale, a data signal supplied to a first pixel connected to a first position of the main scan line is output later than each of a data signal supplied to a second pixel connected to a second position of the main scan line and a data signal supplied to a third pixel connected to a third position of the main scan line, wherein the pixels include the first to third pixels, wherein the first position of the main scan line corresponds to an intermediate point between the first contact point and the second contact point, wherein the second position of the main scan line is closer to the first contact point than the first position, and wherein the third position of the main scan line is closer to the second contact point than the first position.

10. The display device of claim 8, wherein when the scan signal is supplied to the main scan line, output timings of the data signals for a same grayscale are faster as the data lines are closer from the first pixel to the first contact point or the second contact point.

11. The display device of claim 8, wherein when the scan signal is supplied to the main scan line, output timings of the data signals for a same grayscale output to the data lines connected to the pixels on a side of the first contact point opposite to the first position are further delayed as a distance from the first contact point increases.

12. The display device of claim 8, wherein when the scan signal is supplied to the main scan line, output timings of the data signals for a same grayscale output to the data lines connected to the pixels on a side of the second contact point opposite to the first position are further delayed as a distance from the second contact point increases.

13. The display device of claim 8, wherein the controller further delays the output timing of the data signals as a load of the main scan line increases.

14. The display device of claim 8, wherein first sub-scan lines and second sub-scan lines of the scan lines gradually increase in length measured in the second direction toward the first direction.

15. The display device of claim 1, wherein the data driver comprises:

a latch which latches image data and outputs latched image data in units of pixel rows;

a digital-to-analog converter which converts the latched image data into the data signals; and an output buffer which outputs the data signals to the data lines.

16. The display device of claim 15, wherein the controller comprises:

a memory in which over-driving values and shift values corresponding to predetermined points of the pixel unit are stored;

a slew rate controller which generates an over-driving pulse of a data signal supplied to a target pixel based on a position of the main scan line to which the target pixel is connected and the over-driving values; and a latch controller which controls an output timing of the latched image data from the latch based on a position of the target pixel on the main scan line and the shift values.

17. The display device of claim 15, wherein the controller adjusts a bias voltage supplied to the output buffer according to a scan line to which the scan signal is supplied among the scan lines.

18. The display device of claim 17, wherein the controller comprises:

a memory in which bias values and shift values corresponding to predetermined points of the pixel unit are stored;

a slew rate controller which adjusts the bias voltage supplied to the output buffer corresponding to the target pixel based on the position of the main scan line to which the target pixel is connected and the bias values; and a latch controller which controls output timings of the image data of the latch based on a position of the target pixel on the main scan line and the shift values.

19. The display device of claim 17, wherein the controller increases the bias voltage as the load of the data lines increases.

20. The display device of claim 2, wherein the controller adjusts the output timing of the data signals according to a position of a target pixel connected to the main scan line to which the scan signal is supplied.

* * * * *